US006026867A

United States Patent [19]

Klarl

[11] Patent Number: 6,026,867

[45] Date of Patent: Feb. 22, 2000

[54] ROTARY FILLING MACHINE

[75] Inventor: Hermann Klarl, Thalmassing, Germany

[73] Assignee: Krones AG Hermann Kronseder Maschinenfabrik, Germany

[21] Appl. No.: 09/116,519

[22] Filed: Jul. 16, 1998

[30] Foreign Application Priority Data

Jul. 24, 1997 [DE] Germany ..... 297 13 155 U

[51] Int. Cl.[7] ..... B65B 1/04; B65B 43/42

[52] U.S. Cl. ..... 141/91; 141/150

[58] Field of Search ..... 141/145, 148, 141/150, 48, 51, 63, 85, 89, 91, 93, 97, 275, 372, 92

[56] References Cited

U.S. PATENT DOCUMENTS 3,138,178 6/1964 Martin ..... 141/82
3,670,786 6/1972 Levin et al. ..... 141/92
4,489,769 12/1984 Catelli ..... 141/91

FOREIGN PATENT DOCUMENTS

405402 A2 of 0000 European Pat. Off. .

*Primary Examiner*—Henry J. Recla
*Assistant Examiner*—Peter deVore
*Attorney, Agent, or Firm*—Tilton, Fallon, Lungmus & Chestnut

[57] ABSTRACT

In order to provide a rotary filling machine, as used for bottling liquids, by means of which high-purity bottling conditions can be maintained, an ultraclean room is provided and implemented in the area of the path on which the bottles circulate, the upper ceiling wall of said ultraclean room being defined, at least partially, by the lower surface of an annular vessel storing the liquid to be bottled and by the lower surface of the filling valves arranged immediately below said annular vessel.

10 Claims, 2 Drawing Sheets

ROTARY FILLING MACHINE

DESCRIPTION

Figure 1:
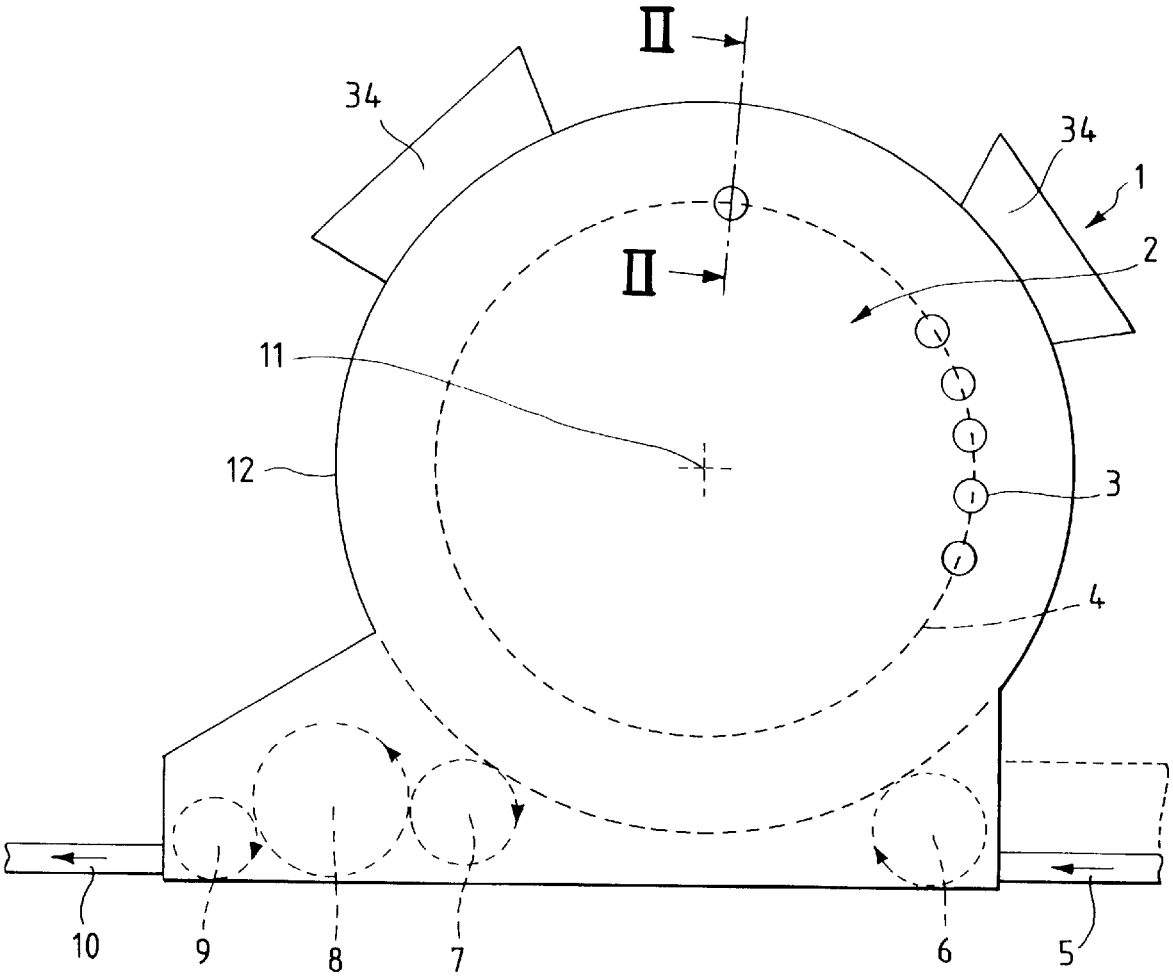

The present invention refers to a rotary filling machine for filling liquids, especially beverages, into vessels, in particular bottles, under high-purity bottling conditions, comprising a plurality of filling valves arranged on the periphery of a rotor, holding elements for holding the vessels under the filling valves during circulation, and an ultraclean room delimited by an inner wall, an outer wall, a ceiling wall and a bottom wall in the area of the path on which the bottles circulate, a high-purity atmosphere being maintained in said ultraclean room by introducing high-purity gas, e.g. sterile air, during the bottling process.

For certain beverages, it is necessary to carry out the bottling process under high-purity conditions so as to prevent the beverages from coming into contact with pests, e.g. moulds, impairing the keeping time and the quality of the beverage. This applies especially to non-alcoholic beverages and to $CO_2$-free beverages, which have a pH value of less than 4.5. Since such beverages are particularly also susceptible to spoilage caused e.g. by moulds and since moulds predominantly occur in the form of air contaminants, additional measures in the field of ventilation technology have to be taken in bottling plants of this kind which are suitable for bottling such beverages.

A filling machine which is intended to be used for this kind of bottling processes is described in European application 405 402. This filling machine is implemented as a rotary filling machine. It is provided with filling valves which are distributed on the circumference thereof. Bottles are held below the filling valves by means of holding elements which circulate on the filling machine in a delimited area defining an ultraclean room. The ultraclean room is delimited by suitable walls, viz. an inner wall, an outer wall, a ceiling wall and a bottom wall. The ceiling wall is defined by an upper filling plate and the bottom wall is defined by a lower filling plate. The inner wall extends between the two plates. The stationary outer wall, however, defines slots towards the ceiling wall and the bottom wall through which the sterile air blown into the thus defined room can escape. The sterile air is introduced into the ultraclean room from the ceiling plate and around the filling valve. The bottles stand upright on the bottom plate in the ultraclean room and are laterally held by means of holding elements, which, however, do not permit any vertical movement of the bottles. Since the filling member extends through the ceiling wall and communicates via a conduit with the storage receptacle arranged above the filling machine and since the actual filling valve is arranged outside of the ultraclean room, the danger exists that, during the filling process, germs may penetrate into the ultraclean room over the length of the connecting conduit and the elements connected thereto, such as filling valve and flowmeter.

Starting from this prior art, it is the object of the present invention to provide a rotary filling machine by means of which high-purity bottling conditions can be maintained and which simultaneously has a structural design that is as simple as possible.

In a rotary filling machine of the type mentioned at the beginning, this object is achieved by the features that the ceiling wall delimiting the ultraclean room at the top is defined, at least partially, by the lower surface of an annular vessel storing the liquid to be bottled and by the lower surface of the filling valves arranged immediately below said annular vessel.

Due to the fact that the ceiling wall delimiting the ultraclean room at the top is defined, at least partially, by the lower surface of an annular vessel storing the liquid to be bottled and by the lower surface of the filling valves arranged immediately below said annular vessel, the filling valves themselves are arranged in the ultraclean room and the liquid can flow directly from the annular vessel to the filling valves so that the liquid bottling paths are as short as possible and so that the liquid to be bottled can be bottled without any risk of contamination by germs. The fact that part of the upper ceiling wall is defined by the lower surface of the annular vessel itself additionally simplifies the structural design. Taking all this into account, the combination of these features therefore provides the possibility of guaranteeing a high-purity bottling operation on the basis of a simple structural design.

An advantageous embodiment of the present invention provides the feature that part of the ceiling wall is defined by a plate supporting the annular vessel. Drive rods defining part of the drive elements for the holding elements preferably extend through this part of the ceiling wall. In this connection it will also be advantageous when these drive rods extend through sleeves whose length corresponds at least to the displacement height of the holding elements. The sleeve, which encompasses the drive rod, provides there a room in which a sterile air atmosphere prevails. When the length of the sleeves corresponds at least to the displacement height, this means that the part of the drive rod located outside of the sleeve in the raised condition will, when lowered, still remain in the area of the sleeve so that no germs from the outer atmosphere will be introduced in the interior of the ultraclean room—not even when the holding elements have been lowered.

A further development of the present invention provides the features that the outer wall and preferably also the bottom wall are arranged on a support frame in such a way that, if necessary, they permit access to the ultraclean room. Such access can, for example, be possible on the basis of a structural design in the case of which the outer wall and/or the bottom wall is/are divided into individual segments arranged on the support frame by means of hinges so that, when access to the interior of the ultraclean room is required, the outer wall can be opened at the location in question. This can, of course, also be achieved by arranging the outer wall such that the whole outer wall can be removed from the support frame. It follows that the bottom wall and the outer wall do not rotate together with the filling machine, but are held by the support frame and permit access, if necessary. The ceiling wall, part of which is defined by the lower surface of the annular vessel, and the inner wall rotate, however, together with the rotor of the rotary filling machine.

In order to maintain a continuous flow of the sterile air introduced in the ultraclean room, air-outlet slots are provided, preferably between the bottom wall and the inner wall as well as between the outer wall and the ceiling wall. It follows that sterile air (this refers to any gas satisfying the desired purity requirements) is continuously fed into the clean room under overpressure, and this sterile air will then escape through the slots so that the clean room is constantly flushed with gas; this will improve the maintenance of high-purity bottling conditions still further.

In accordance with a further embodiment of the present invention, the sterile gas enters the ultraclean room through lateral gas inlet openings provided in the area of the outer wall. These gas inlet openings can be provided at several points, distributed over the side wall, so that a uniform introduction of gas is possible.

When the bottom wall is inclined downwards towards the air-outlet slot, it is guaranteed that a possibly occurring spatter of liquid or liquid flowing out of a leaking bottle, which has not been detected, and falling on the bottom wall will flow automatically in the direction of the air-outlet slot or rather be entrained by the gas stream directed towards the air-outlet slot so that no permanent accumulations of liquid in the area of the bottom wall will have to be reckoned with.

Figure 2:
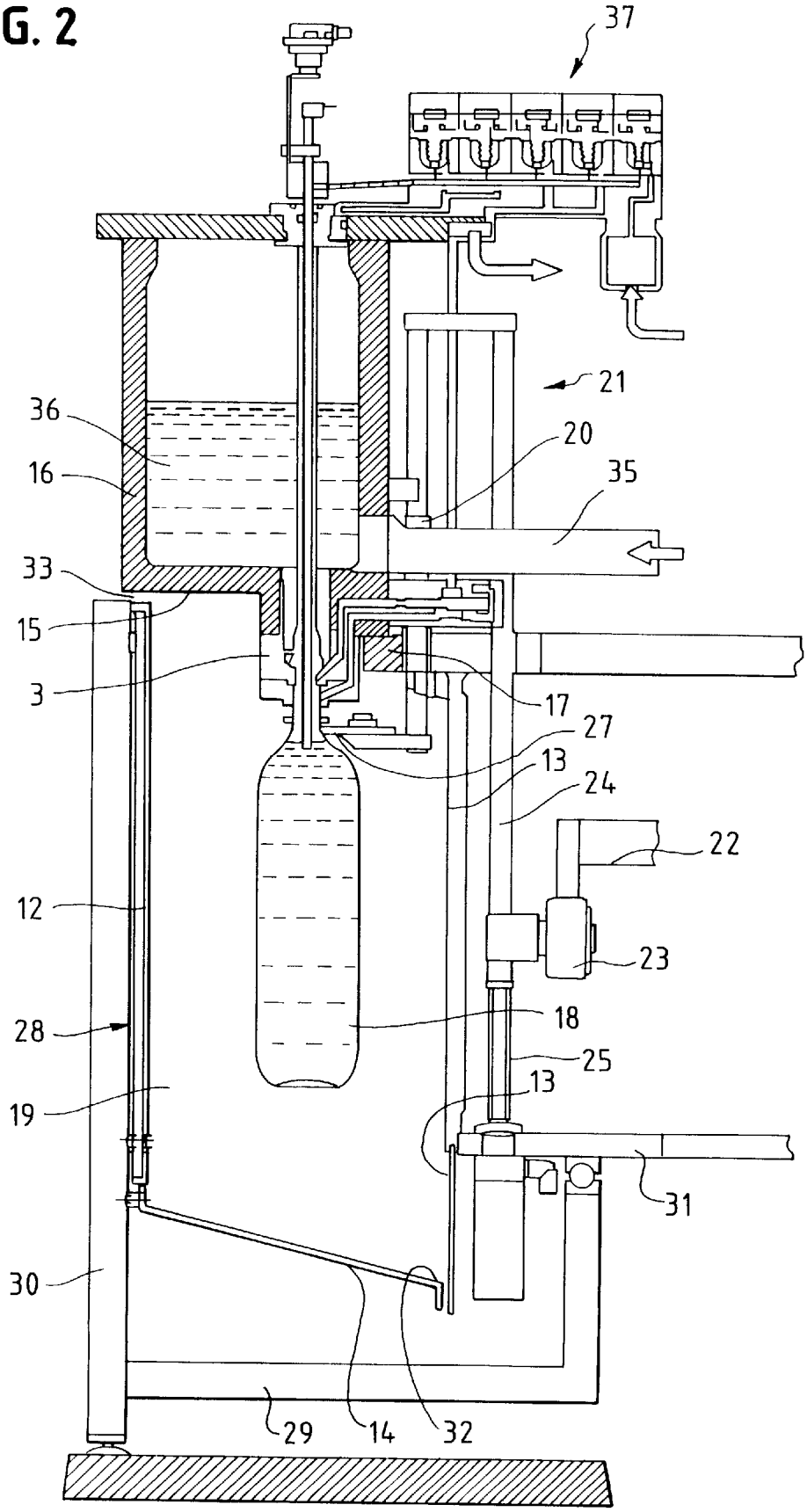

In the following, the present invention will be explained and described still further on the basis of the embodiment shown in the drawing, in which:

FIG. 1 shows a schematic top view of a rotary filling machine according to the present invention and FIG. 2 shows a sectional view along line II—II of FIG. 1.

FIG. 1 shows in a schematic top view the fundamental structural design of the rotary filling machine 1 according to the present invention. The rotary filling machine 1 comprises a rotor 2 on the periphery of which a plurality of uniformly distributed filling valves 3 is arranged. When the rotor 2 is driven about the axis 11, the filling valves circulate on the circulation path 4. When said filling valves circulate, bottles 18, which are held under the filling valves 3 (cf. FIG. 2), are filled.

The bottles 18 are transferred to the rotor 2 in the manner known via a feed belt 5 and a feed star 6. After circulation, the bottles 18 are transferred to a closing machine 8 by the transfer star 7. When the bottles 18 have been closed, they are taken over by a discharge star 9 and transferred to a discharge belt 10, and from said discharge belt 10 they are transferred to the next station for further treatment.

In order to be able to fill the bottles 18 under high-purity conditions, an ultraclean room delimited by the outer wall 12 is produced in the area of the circulation path on the rotor 2, said ultraclean room accommodating not only the filling valves 3 but also the feed star 6, the transfer star 7, the closing machine 8 as well as the discharge star 9 of said closing machine.

Through lateral gas inlet openings 34 provided on the periphery in the area of the outer wall 12, sterile air is supplied (supply of sterile gas) so that, during the filling operation, a high-purity atmosphere can be maintained within the room delimited by the outer wall 12.

The sectional view of FIG. 2 in the area of line II—II of FIG. 1 shows the structural design more clearly. An annular vessel 16 into which the liquid 36 to be bottled is introduced through a liquid feed conduit 35 is arranged on a rotor plate 17 defining part of the rotor 2 and circulating together therewith.

The filling valves 3 are arranged directly at the lower outlet of the annular vessel 16. The lower surface 15 of the annular vessel 16, the lower surface of the filling valve 3 as well as the lower surface of the plate 17 define an upper ceiling wall of the ultraclean room 19 located below said components, said ultraclean room 19 being delimited on the sides by the cylindrical inner wall 13, which is secured to the plate 17, in the direction of the rotor axis 11 and, radially outwards, by the stationary, partially cylindrical outer wall 12. At the bottom, this room is closed by the inclined, stationary bottom wall 14. The walls 12 and 14 extend substantially around the whole circumference of the rotor 2, suitable feed and discharge openings being, however, provided in the area where the bottles are fed and discharged (cf. FIG. 1).

The outer wall 12 and the bottom wall 14 are supported via a support frame 28 with circumferentially distributed pillars 30 and arms 29 branching from said pillars, said arms 29 extending inwards towards the rotor axis and supporting the lower support plate 31 of the rotor 2 via a ball bearing rim in a rotatable manner, the inner wall 13 which carries the upper plate 17 being secured to said lower support plate 31. The outer wall 12 can be subdivided into individual segments along the periphery thereof, each of said segments being adapted to be opened individually, e.g. with the aid of hinges, so that access to the ultraclean room is possible. Preferably, also the bottom wall 14 is adapted to be removed or pivoted away in a suitable manner.

The bottles 18, which are PET plastic bottles in the embodiment shown, are pressed by holding elements 27 onto the discharge opening of the filling valve 3. Each holding element 27 is moved up and down via drive elements 21, i.e. it takes hold of a bottle 18 occupying a lower position at the location of bottle feeding and transfers it to the position shown in FIG. 2, viz. directly to the discharge end of the filling valve 3. After the filling operation, the bottle 18 is lowered via the drive elements 21. The drive elements 21 comprise drive rods 20, connecting rods 24, the pneumatic spring 25, the sensing roller 23 as well as the control cam 22. The control cam 22 is arranged in a stationary manner within the rotating parts of the rotor 2 and, via the sensing roller 23 in combination with the upwardly acting pneumatic spring 25, it causes the connecting rods 24 to be lifted and lowered so that, in this way, also the drive rods 20 and the holding elements 27 are controlled from the inner side of the wall 13 and of the rotor 2, respectively. In the area of the rotor plate 17, passage means in the form of sleeves 26 are provided, the drive rods 20 extending through said sleeves 26. The length of these sleeves 26 is dimensioned such that it corresponds at least to the displacement height of the connecting rods 24 so that, when lowered, the upper part of the drive rods 20, which is located outside of the sleeve 26 at the position shown, will remain within the sleeve 26; this will also have the effect that germs, which may have deposited on the upper part of the drive rods 20 which is not located in the ultraclean room 19, are prevented from being introduced into the interior of said ultraclean room 19 when the connecting rods are being lowered.

The actual filling process takes place in a manner known per se. For this purpose, the individual filling valves 3 and additional control valves 37 are acted upon in a suitable manner for introducing cleaning gas, controlling the discharge of reflux gas, opening the liquid valve and the like.

As has already been described, sterile air is continuously blown into the ultraclean room 19 via lateral sterile-air feed openings 34 arranged on the outer wall 12. This sterile air can escape through an air-outlet slot 32 between the bottom wall 14 and the inner wall 13 on the one hand and through an air-outlet slot 33 between the outer wall 12 and the lower surface 15 of the annular vessel 16 on the other so that the ultraclean room 19 is constantly flushed. A small amount of sterile gas can also escape through the space between the drive rod 20 and the sleeve 26, i.e. through the interior of the sleeve 26, so that the sleeve 26 is also constantly flushed towards the outside.

Since the bottle 18 is held by means of holding elements 27 directly on the filling valve 3 arranged on the annular vessel 16 and since the paths along which the liquid flows into the bottle 18 are very short, a high-purity atmosphere without any risk of introducing germs is maintained in the area of the actual filling operation. Sterile air flows constantly around the discharge opening of the filling valve 3 and also around the bottle neck so that a filling operation under high-purity conditions (values as low as less then 100 germs per $m^3$ can be achieved) can be maintained and carried out. Due to the fact that the drive elements for the holding elements 27 are located outside of the ultraclean room 19 in the direction of the rotor axis and extend into the ultraclean room 19 itself only with drive rods 20 used for raising and lowering the holding elements 27, which may for example be holding clips, the ultraclean room 19 as such remains free of built-in components to a very large extent. Due to the fact that the drive is effected from inside, there is also the possibility of free access from outside, when the wall 12 is removed or opened.

If liquid should accumulate outside of the bottle 18 in the area of the ultraclean room 19 (e.g. due to fracture of a bottle), the liquid accumulating can escape along the bottom wall 14 through the outlet slot 32 or it will be entrained by the sterile air discharged, which flows in the direction of the air-outlet slot 32, whereby the ultraclean room 19 will be kept clean.

I claim:

1. A rotary filling machine for filling liquids into vessels under high-purity bottling conditions, comprising in combination a plurality of filling valves arranged on the periphery of a rotor, holding elements for holding the vessels under said filling valves during circulation, an ultraclean room delimited by an inner wall, an outer wall, a ceiling wall and a bottom wall in the area of the path on which the bottles circulate, a high-purity atmosphere being maintained in said ultraclean room by introducing high-purity gas during the bottling process, and said ceiling wall delimiting the ultraclean room (19) at the top is defined, at least partially, by the lower surface (15) of an annular vessel (16) storing the liquid (36) to be bottled and by the lower surface of said filling valves (3) arranged immediately below said annular vessel (16).

2. A rotary filling machine according to claim 1, wherein part of said ceiling wall is defined by a plate (17) of said rotor (2), said plate (17) supporting said annular vessel (16).

3. A rotary filling machine according to claim 1, and wherein drive rods (20) of said holding elements (27) extend through said ceiling wall.

4. A rotary filling machine according to claim 3, wherein said drive rods (20) extend through the part of said ceiling wall defined by said plate (17).

5. A rotary filling machine according to claim 3 or 4, wherein said drive rods (20) extend through sleeves (26) whose length (1) corresponds at least to the displacement height of said holding elements (27).

6. A rotary filling machine according to claim 1, 2, 3 or 4, and wherein an air-outlet slot (33) is provided between said outer wall (12) and said ceiling wall.

7. A rotary filling machine according to claim 1, 2, 3 or 4, and wherein said high purity gas enters said ultraclean room (19) through lateral gas inlet openings (34) provided in the area of said outer wall (12).

8. A rotary filling machine according to claim 1, and wherein an air-outlet slot (32) is provided between said bottom wall (14) and said inner wall (13).

9. A rotary filling machine according to claim 8, wherein said bottom wall (14) is inclined downwards towards said air-outlet slot (32).

10. A rotary filling machine according to claim 1, wherein said high-purity gas is sterile air.

* * * * *